US010964993B2

(12) United States Patent
Olivadese et al.

(10) Patent No.: US 10,964,993 B2
(45) Date of Patent: Mar. 30, 2021

(54) CRYOGENIC-STRIPLINE MICROWAVE ATTENUATOR

(71) Applicant: International Business Machines Corporation, Armonk, NY (US)

(72) Inventors: Salvatore Bernardo Olivadese, Stamford, CT (US); Patryk Gumann, Tarrytown, NY (US); Jay M. Gambetta, Yorktown Heights, NY (US); Jerry M. Chow, White Plains, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 16/591,225

(22) Filed: Oct. 2, 2019

(65) Prior Publication Data

US 2020/0036072 A1 Jan. 30, 2020

Related U.S. Application Data

(63) Continuation of application No. 15/922,105, filed on Mar. 15, 2018, now Pat. No. 10,476,122.

(51) Int. Cl.
*H01P 1/22* (2006.01)
*H01P 1/30* (2006.01)
(Continued)

(52) U.S. Cl.
CPC ..... *H01P 1/227* (2013.01); *H01P 1/30* (2013.01); *H01P 3/08* (2013.01); *H01P 11/003* (2013.01)

(58) Field of Classification Search
CPC ..... H01P 1/227; H01P 1/30
(Continued)

(56) References Cited

U.S. PATENT DOCUMENTS 3,710,286 A 1/1973 Aizu et al.
4,260,965 A 4/1981 Nakamura et al.
(Continued)

FOREIGN PATENT DOCUMENTS

GB 2473078 3/2011
JP H1174705 3/1999

OTHER PUBLICATIONS

Notice of Allowance received for U.S. Appl. No. 15/922,105 dated Jul. 3, 2019, 18 pages.
(Continued)

*Primary Examiner* — Stephen E. Jones
(74) *Attorney, Agent, or Firm* — Amin, Turocy & Watson, LLP

(57) ABSTRACT

The technology described herein is directed towards a cryogenic-stripline microwave attenuator. A first high thermal conductivity substrate such as sapphire and a second high thermal conductivity substrate such as sapphire, along with a signal conductor comprising one or more attenuator lines between the substrates form a stripline. A compression component such as one or more screws, vias (plus clamps) and/or clamps presses the first high thermal conductivity substrate against one side of the signal conductor and presses the second high thermal conductivity substrate against another side of the signal conductor. The high thermal conductivity of the substrates facilitates improved thermalization, while the pressing of the substrates against the conductor reduces the thermal boundary (Kapitza) resistance and thereby, for example, improves thermalization and reduces thermal noise.

25 Claims, 8 Drawing Sheets

(51) Int. Cl.
*H01P 11/00* (2006.01)
*H01P 3/08* (2006.01)

(58) Field of Classification Search
USPC ..... 333/81 R, 81 B, 81 A, 99 S
See application file for complete search history.

(56) References Cited

U.S. PATENT DOCUMENTS

| | | | | |
|---|---|---|---|---|
| 7,936,248 | B2 | 5/2011 | Yoon et al. | |
| 8,604,892 | B2 | 12/2013 | Ikuma | |
| 8,644,896 | B1 | 2/2014 | Bock et al. | |
| 9,520,853 | B2 | 12/2016 | Laighton et al. | |
| 9,590,591 | B1 | 3/2017 | Ashry-Othman | |
| 9,602,091 | B1 | 3/2017 | Sharma | |
| 10,476,122 | B2 * | 11/2019 | Olivadese | H01P 3/08 |
| 2016/0267032 | A1 * | 9/2016 | Rigetti | G06F 13/4068 |

OTHER PUBLICATIONS

Pierantoni et al., "Graphene-based Electronically Tuneable Microstrip Attenuator", Conference Paper in Nanomaterials and Nanotechnology, Jun. 2014, 7 pages.

Zagorodny et al., "Microwave microstrip attenuators for GaAs monolithic integrated circuits", XIII International Conference and Seminar on Micro/Nanotechnologies and Electron Devices EDM, 2012, 5 pages.

Carlson et al., "Thermal Conductivity of GaAs and GaAs1-xPx Laser Semiconductors", Journal of Applied Physics 36, 505, 1965, 4 pages.

Berman, "Thermal conductivity of polycrystalline A1203 vs. temperature", 1952, 1 page.

Touloukian et al., "Thermophysical Properties of Matter—The TPRC Data Series", Thermal Conductivity—Nonmetallic Solids, vol. 2, 5 pages.

Swartz et al., "Thermal boundary resistance", Reviews of Modem Physics, vol. 61, No. 3, Jul. 1989, 64 pages.

Yeh et al., "Microwave attenuators for use with quantum devices below 100 mK", last accessed on Jan. 31, 2018, 10 pages.

Xmacorp.com, "Cryogenic Passive Attenuator and Termination", last accessed on Jan. 31, 2018, 2 pages.

International Search Report and Written Opinion received for PCT Application Serial No. PCT/EP2019/053738 dated May 20, 2019, 19 pages.

Cano et al., "Ultra-Wideband Chip Attenuator for Precise Noise Measurements at Cryogenic Temperatures", IEEE Transactions on microwave theory and techniques, vol. 58, No. 9, Sep. 1, 2010. pp. 2504-2510.

Yeh et al., "Microwave attenuators for use with quantum devices below 100 mK", Journal of Applied Physics, American Institute of Physics, vol. 121, No. 22, Jun. 8, 2017, 8 pages.

Anonymous, "USPAS Cryogenics Short Course", URL: http://uspas.fnal.gov/materials/10MIT/Lecture_1.2.pdf, Jun. 14, 2010, pp. 1-53.

List of IBM Patents or Applications Treated as Related.

* cited by examiner

CRYOGENIC-STRIPLINE MICROWAVE ATTENUATOR

BACKGROUND

The subject disclosure relates generally to microwave attenuators, and more particularly to a cryogenic-stripline microwave attenuator device for quantum computing. Microwave attenuators are used to provide microwave signals with relatively stable power levels across a wide range of frequencies. Room temperature microwave attenuators are widely available, but such devices are not efficient from a thermal perspective. Other commercial microwave attenuators are not designed for thermalization or to reduce thermal noise, and do not have both good thermal performance and microwave performance at low temperatures.

SUMMARY

The following presents a summary to provide a basic understanding of one or more embodiments of the invention. This summary is not intended to identify key or critical elements, or delineate any scope of the particular embodiments or any scope of the claims. Its sole purpose is to present concepts in a simplified form as a prelude to the more detailed description that is presented later.

According to an embodiment, a device can comprise a cryogenic-stripline microwave attenuator, comprising, a first high thermal conductivity substrate and a second high thermal conductivity substrate. The device can further comprise a signal conductor comprising one or more attenuator lines between the first high thermal conductivity substrate and the second high thermal conductivity substrate, the signal conductor compressed by a compression component that presses the first high thermal conductivity substrate against one side of the signal conductor and presses the second high thermal conductivity substrate against another side of the signal conductor.

The first high thermal conductivity substrate and the second high thermal conductivity substrate can comprise a first sapphire substrate and a second sapphire substrate, respectively. The compression component can comprise at least one via, at least one screw and/or at least one clamping component. The compression component facilitates thermal conductivity between the substrates and the signal conductor. The compression component reduces thermal boundary resistance between the substrates and the signal conductor to increase thermal conductivity.

According to another embodiment, a device can comprise an attenuator, comprising a first sapphire substrate and a second sapphire substrate. The device can further comprise a signal conductor between the first sapphire substrate and the second sapphire substrate, the signal conductor compressed by a compression component that presses the first sapphire substrate against one side of the signal conductor and presses the second sapphire substrate against another side of the signal conductor. The compression component facilitates thermal conductivity of the signal conductor and reduces thermal boundary resistance between the substrates and the signal conductor.

According to yet another embodiment, a method is provided. The method can comprise constructing a cryogenic-stripline microwave attenuator, embedding attenuator lines between a first high thermal conductivity substrate and a second high thermal conductivity substrate, and compressing the attenuator lines, comprising pressing the first high thermal conductivity substrate against one side of the signal conductor and pressing the second high thermal conductivity substrate against another side of the signal conductor. The method can further comprise locating the cryogenic-stripline microwave attenuator in a cryogenic dilution refrigerator of a quantum computing device.

According to another embodiment a device comprising a cryogenic-stripline microwave attenuator can be provided. The device can comprise a signal conductor comprising an attenuator, the signal conductor having a substantially first flat side and a substantially second flat side opposite the first flat side. A first high thermal conductivity substrate can be pressed against the first side of the signal conductor by a compression component, and a second high thermal conductivity substrate can be pressed against the second side of the signal conductor by the compression component.

According to yet another embodiment, a cryogenic-stripline microwave attenuator is described. A signal conductor comprising an attenuator can have a first side pressed against a first high thermal conductivity substrate by a compression component, and can have a second side pressed against a second high thermal conductivity substrate by the compression component. Within a dilution refrigerator, the signal conductor can receive an input signal and can attenuate the input signal into a desired attenuated signal at an output of the attenuator

DETAILED DESCRIPTION

Figure 1:
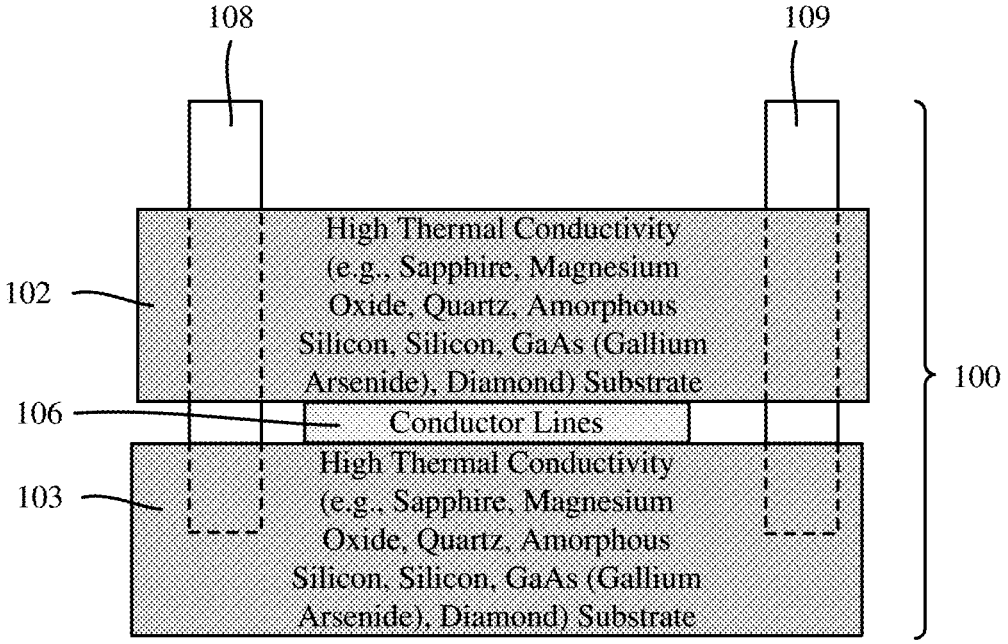
FIG. 1 is a front view of a cryogenic-stripline attenuator structure in which the substrates can be pressed together using screws or vias with clamps or the like to press into the attenuator lines according to an example embodiment of the present disclosure.

The following detailed description is merely illustrative and is not intended to limit embodiments and/or application or uses of embodiments. Furthermore, there is no intention to be bound by any expressed or implied information presented in the preceding sections, or in the Detailed Description section.

One or more embodiments are now described with reference to the drawings, wherein like referenced numerals are used to refer to like elements throughout. In the following description, for purposes of explanation, numerous specific details are set forth in order to provide a more thorough understanding of the one or more embodiments. It is evident, however, in various cases, that the one or more embodiments can be practiced without these specific details.

Further, it is to be understood that the present disclosure will be described in terms of a given illustrative architecture; however, other architectures, structures, substrate materials and process features, and steps can be varied within the scope of the present disclosure.

It will also be understood that when an element such as a layer, region or substrate is referred to as being "on" or "over" another element, it can be directly on the other element or intervening elements can also be present. In contrast, only if and when an element is referred to as being "directly on" or "directly over" another element, are there are no intervening element(s) present. Note that orientation is generally relative; e.g., "on" or "over" can be flipped, and if so, can be considered unchanged, even if technically appearing to be under or below/beneath when represented in a flipped orientation. It will also be understood that when an element is referred to as being "connected" or "coupled" to another element, it can be directly connected or coupled to the other element or intervening elements can be present. In contrast, only if and when an element is referred to as being "directly connected" or "directly coupled" to another element, are there no intervening element(s) present.

Reference in the specification to "one embodiment" or "an embodiment" of the present principles, as well as other variations thereof, means that a particular feature, structure, characteristic, and so forth described in connection with the embodiment is included in at least one embodiment of the present principles. Thus, the appearances of the phrase "in one embodiment" or "in an embodiment," as well any other variations, appearing in various places throughout the specification are not necessarily all referring to the same embodiment. Repetitive description of like elements employed in respective embodiments is omitted for sake of brevity.

The technology described herein is generally directed towards a cryogenic-stripline microwave attenuator suitable for use with quantum computing technologies. In general, the technology is based on the use of double high thermal conductivity (e.g., Sapphire) substrates, with signal conductors (providing an attenuator) between the substrates. Other materials can comprise, but are not limited to, magnesium oxide, quartz, amorphous silicon, silicon, GaAs (Gallium Arsenide) and/or diamond. In general, "high thermal conductivity" materials as referred to herein include materials with thermal conductivity greater than or equal to about 100 W/m/K (watts per meter-kelvin). In general, the substrates surrounding the signal conductors form a stripline, wherein a stripline is a well-known transmission technology suitable for microwave transmissions.

In general, a problem is that known microwave attenuators do not have sufficiently good thermal performance and microwave performance at low temperatures. A solution described herein provides for more optimal thermalization while retaining a suitable microwave response for the attenuator.

To this end, the substrates can be pressed against both sides of the signal conductor using a compression component. This reduces the thermal boundary resistance (also known as interfacial thermal resistance or Kapitza resistance), with a consequent improvement in heat conduction, resulting in improved thermalization and reduced thermal noise. Still further, the technology improves thermalization as a result of the higher thermal conductivity of the high thermal conductivity (e.g., Sapphire) substrates. The technology described herein, with respect to described designs for microwave attenuators, thus solves many thermalization issues in microwave transmission lines for dilution refrigerators in quantum applications.

Referring now to the drawings in which like numerals represent the same of similar elements, FIGS. 1 (front view) and 2 (perspective view) illustrate various structures for providing (e.g., configuring and/or fabricating) a cryogenic-stripline microwave attenuator device 100, including substrates 102 and 103. Note that the structures are not intended to be to scale. Further, note that in FIG. 2, the outside edges of the lower substrate 203 are shown as shaded to help visually distinguish the two surrounding substrate layers.

In one or more embodiments, the substrates 102 and 103 can be sapphire substrates, with either or both sapphire substrates having a thickness of 0.5 mm-1 mm, with a thermal conductivity (K) in the range of 200 W/m/K. Such sapphire substrates with these characteristics are commercially available. The substrates can be the same material, but need not be, however in any event the higher the thermal conductivity the better, above 100 W/m/K, such as 150 W/m/K or higher. Other materials such as quartz, silicon, and other glass-type materials can provide the desired thermal conductivity.

Figure 2:
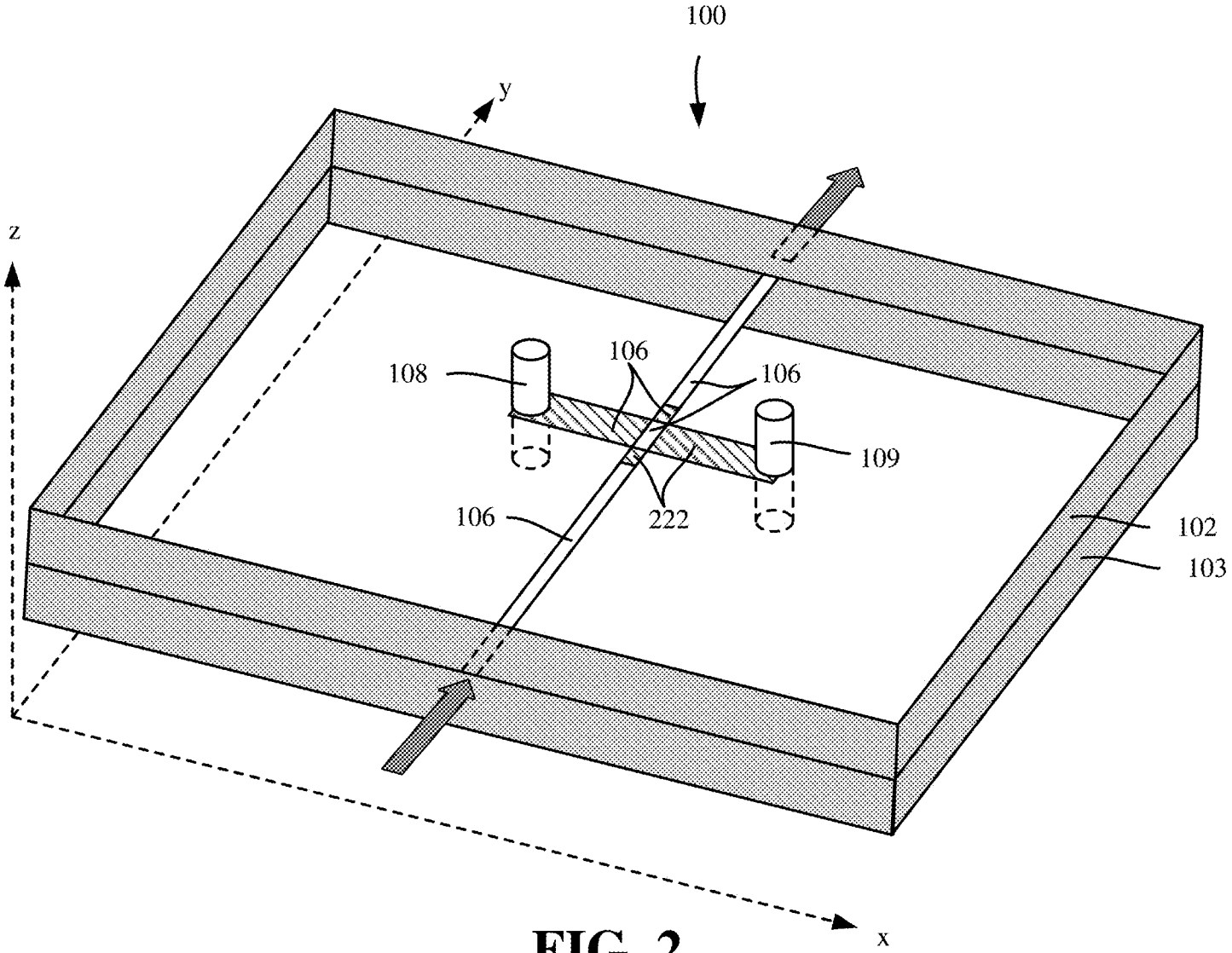
FIG. 2 is a perspective view of a cryogenic-stripline attenuator structure in which the substrates can be pressed together using screws or vias with clamps or the like to compress the attenuator lines according to an example embodiment of the present disclosure.

One or more signal conductor lines 106 are between the substrates 102 and 103. The signal conductor lines 106 can be microstrip lines, such as comprising Nickel Chrome (NiCr)/Copper thin-film conductors, which can be deposited on the substrate using any suitable deposition technique. In general, copper provides the transmission line, while NiCr provides the attenuator portion. As shown in FIG. 2, in conjunction with thin film resistors 222, one embodiment generally comprises a cross-shaped attenuator circuit. The shape of the attenuator can be standard, and can, for example, be derived from Zagorodny et al., "Microwave microstrip attenuators for GaAs monolithic integrated circuits," International Conference and Seminar on Micro/Nanotechnologies and Electron Devices Edm (2012). Note that top and bottom metal ground planes/ground leads are not shown in FIGS. 1 and 2, but as is known, a ground plane is typically above the substrate 102 and another ground plane is typically below the substrate 103 (in the depicted orientations). The substrate materials can be the same thickness, but can be different thicknesses, such as for use with an unbalanced stripline.

Also shown in FIGS. 1 and 2 are compression components 108 and 109. Example compression components comprise screws or vias that press the substrate 102 (e.g., downward as depicted) into the signal conductor lines 106 and press the substrate 103 (e.g., upward as depicted) into the signal conductor lines 106. As can be readily appreciated, a single screw or via may suffice, or more than two such screws or vias can be used, and, for example, can be arranged in both position and/or to individually provide more, the same or less pressure, such as to provide the pressure evenly over the signal conductor, or provide more pressure at certain locations relative to other locations. The increased pressured on the signal conductors using the compression components 108 and 109 (e.g., vias with clamps/screws) conductor facilitate reduced thermal boundary resistance/improve heat conduction, resulting in improved thermalization and reduced thermal noise relative to "room temperature" microwave attenuators, such as those based on GaAs (gallium arsenide, which has a somewhat lower, but still relatively high thermal conductivity (around 100 W/m/K) at low temperatures, e.g., below about 30K), or even lower temperature microwave attenuators based on Alumina.

Figure 3:
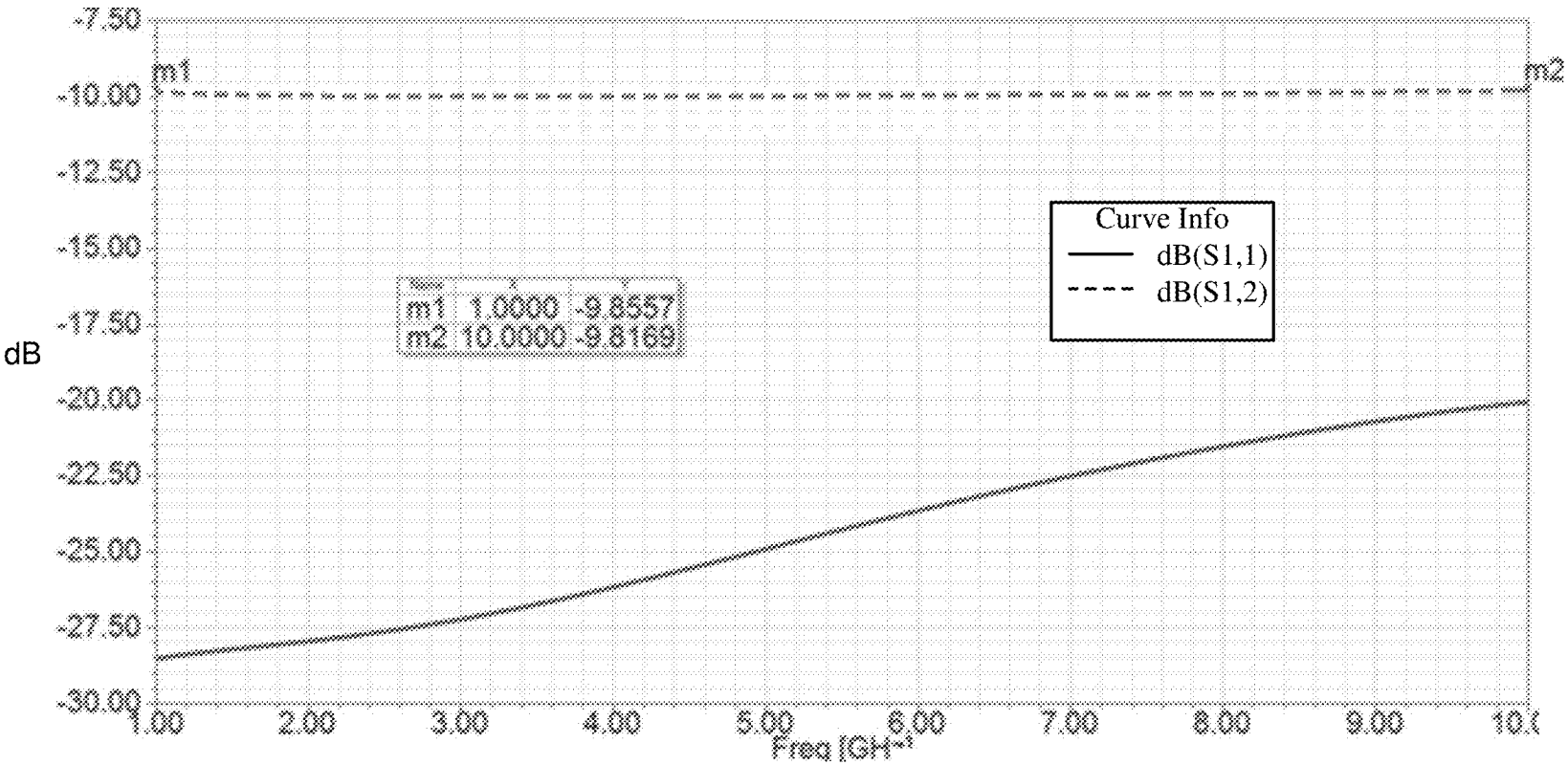
FIG. 3 is a graph showing attenuation versus frequencies for a cryogenic-stripline attenuator according to an example embodiment of the present disclosure.

The technology described herein provides more optimal thermalization in a stripline attenuator, while retaining state of the art microwave response for the attenuator over a wide range of frequencies. FIG. 3 shows a graph of attenuation in decibels (dB) in the frequency band of interest, 1-10 GHz. As can be seen, reflection is minimized, and is extremely flat (around −10 dB) for the attenuator described herein (the dashed line).

Figure 4:
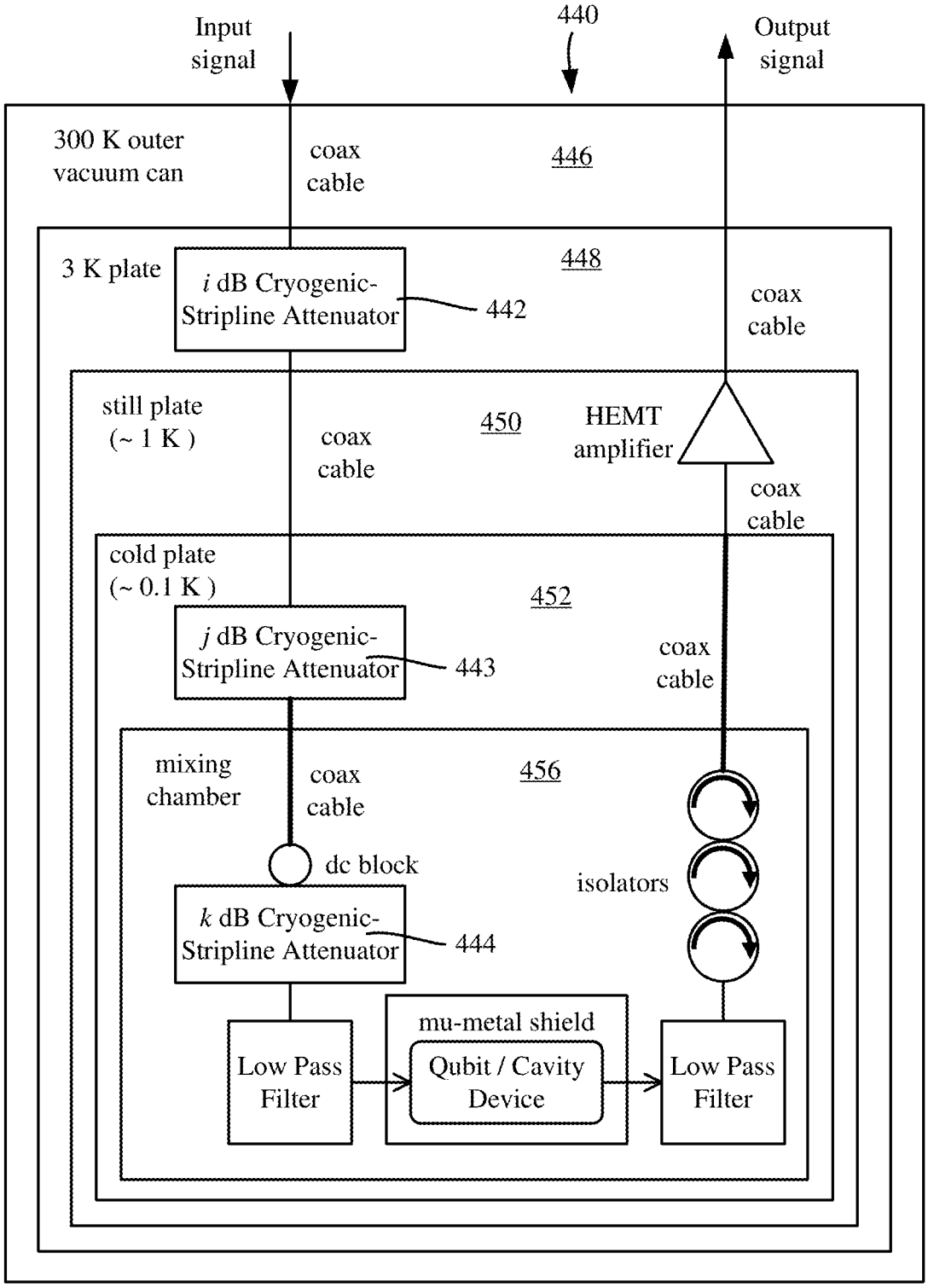
FIG. 4 is a block diagram showing example components for filtering and thermalizing microwave signals in a dilution refrigerator using cryogenic-stripline attenuators according to an example embodiment of the present disclosure.

FIG. 4 shows an example circuit/quantum application 440 in which cryogenic-stripline microwave attenuators 442-444 can be implemented in a dilution refrigerator. Note that the dB values represented by i, j and k in FIG. 4 can be any desired level of attenuation, and any of i, j and k can be the same or different from one another. As generally shown in FIG. 4, the dilution refrigerator can, for example, be contained in an outer vacuum can 446 (e.g., at 300 degrees K) and an e.g. 3 degrees K plate 448 (sometime referred to as the inner vacuum can). The exemplified dilution refrigerator can comprise a still plate 450 (e.g., at approximately 1 degrees K), a cold-plate 452 (e.g., at approximately 0.1 degrees K) and a mixing chamber 454. In general, quantum applications need microwave attenuators on the input/output lines of dilution refrigerator, to reduce signal magnitude, reduce thermal noise, and thermalize conductors. The input signal into a quantum device is attenuated, as can be the output signal from the dilution refrigerator to measurement devices. As described above with reference to FIG. 3, the attenuation is substantially equal over a large frequency band, and thus the technology described herein works well in the circuit/quantum application 440 of FIG. 4. The microwave signals are attenuated by the NiCr/copper lines in the attenuator (FIGS. 1 and 2), while thermal energy is dissipated through the other metals and the high thermal conductivity substrates.

Figure 5:
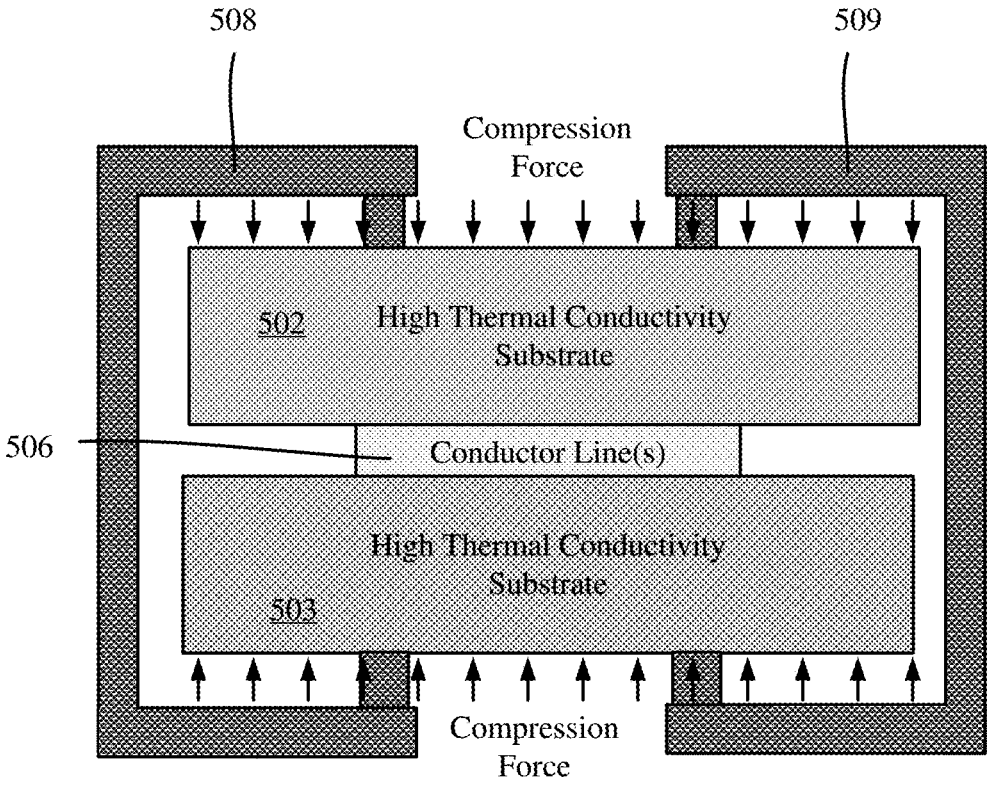
FIG. 5 is a front view of a cryogenic-stripline attenuator structure in which the substrates can be pressed together using a clamp or the like to press into the attenuator lines according to an example embodiment of the present disclosure.

FIG. 5 shows an alternative compression component, comprising, for example, clamps 508 and 509 or the like. Crimping is a similar alternative. As with screws or vias (e.g., with clamps), a single clamp or more than two clamps can be used, and the clamps can be arranged (located and/or tightened) to provide even, more or less pressure at certain locations relative to other locations. As represented by the "compression force" (small arrows) in FIG. 5, in one or more embodiments the compression is applied over the full surfaces of the substrates. Similarly, the increased pressured on the signal conductors using the compression components 508 and 509 facilitate reduced thermal boundary resistance/improve heat conduction, resulting in improved thermalization and reduced thermal noise relative to other known microwave attenuators.

Figure 6:
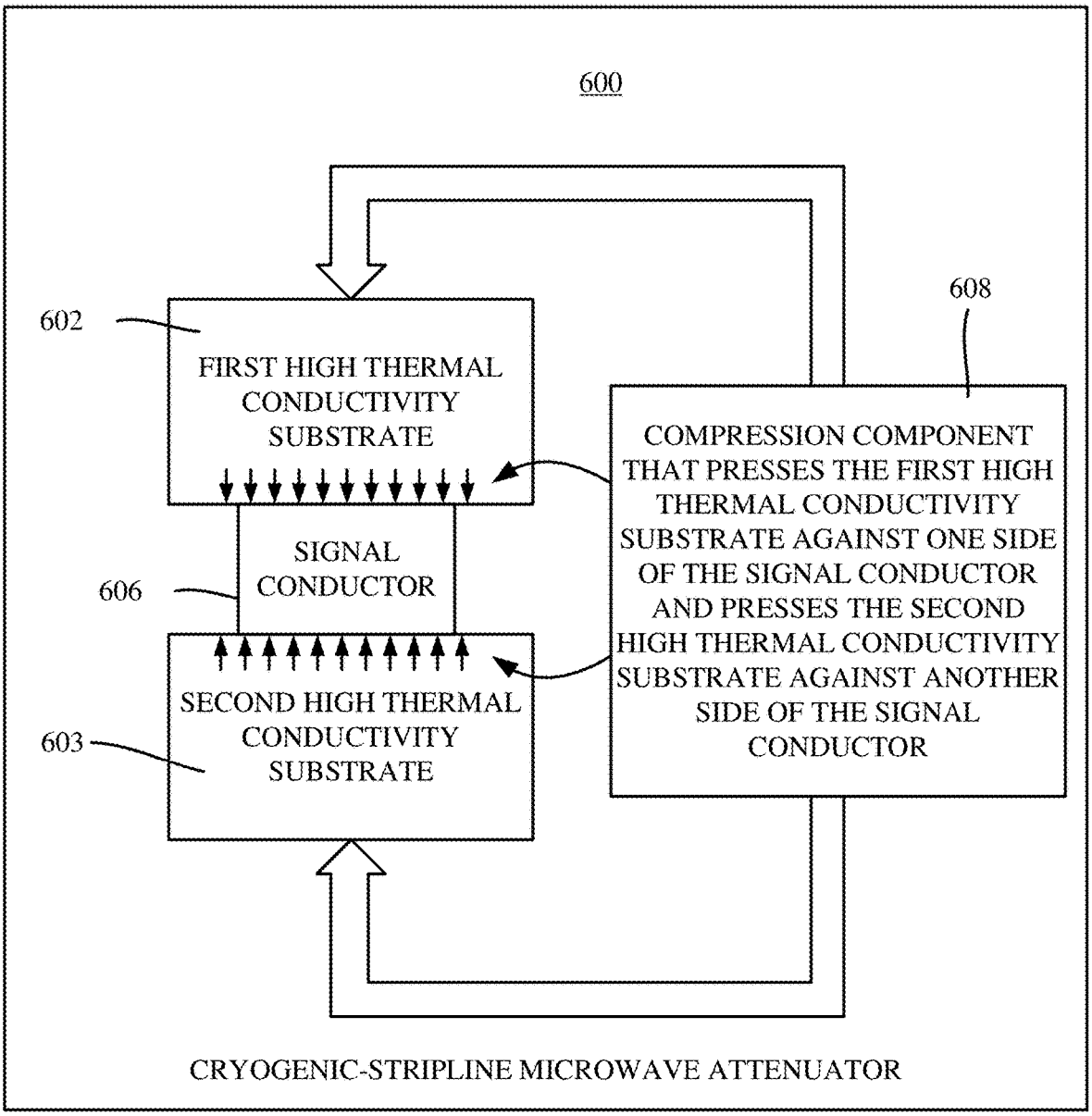
FIG. 6 is a representation of components of a cryogenic-stripline attenuator according to an example embodiment of the present disclosure.

FIG. 6 shows an example embodiment of a device comprising a cryogenic-stripline microwave attenuator 600. The exemplified device can comprise a first high thermal conductivity substrate 602 and a second high thermal conductivity substrate 604. The exemplified device further can comprise a signal conductor 606, comprising one or more attenuator lines between the first high thermal conductivity substrate 602 and the second high thermal conductivity substrate 603. The signal conductor can be compressed by a compression component 608 that presses the first high thermal conductivity substrate 602 against one side of the signal conductor 606 and presses the second high thermal conductivity substrate 603 against another side of the signal conductor 606.

The compression component can comprise at least one via. The compression component can comprise at least one screw. The compression component can comprise at least one clamping component. The compression component can facilitate thermal conductivity of the signal conductor to the substrates. The compression component can reduce thermal boundary resistance between the substrates and the signal conductor; that is, the stronger the compression the higher the thermal conductivity, due to the reduction of boundary resistance.

The first high thermal conductivity can comprise a first sapphire substrate. The first sapphire substrate can have a thickness of about 0.5 to 1.0 millimeter. The first high thermal conductivity substrate has a thermal conductivity of about 200 Watts per meter-Kelvin. The second high thermal conductivity can comprise a second sapphire substrate. The second sapphire substrate can have a thickness of about 0.5 to 1.0 millimeter.

The first high thermal conductivity can comprise a first sapphire substrate and the second high thermal conductivity can comprise a second sapphire substrate. The first sapphire substrate can have a thickness of about 0.5 to 1.0 millimeter and the second sapphire substrate can have a thickness of about 0.5 to 1.0 millimeter.

Figure 7:
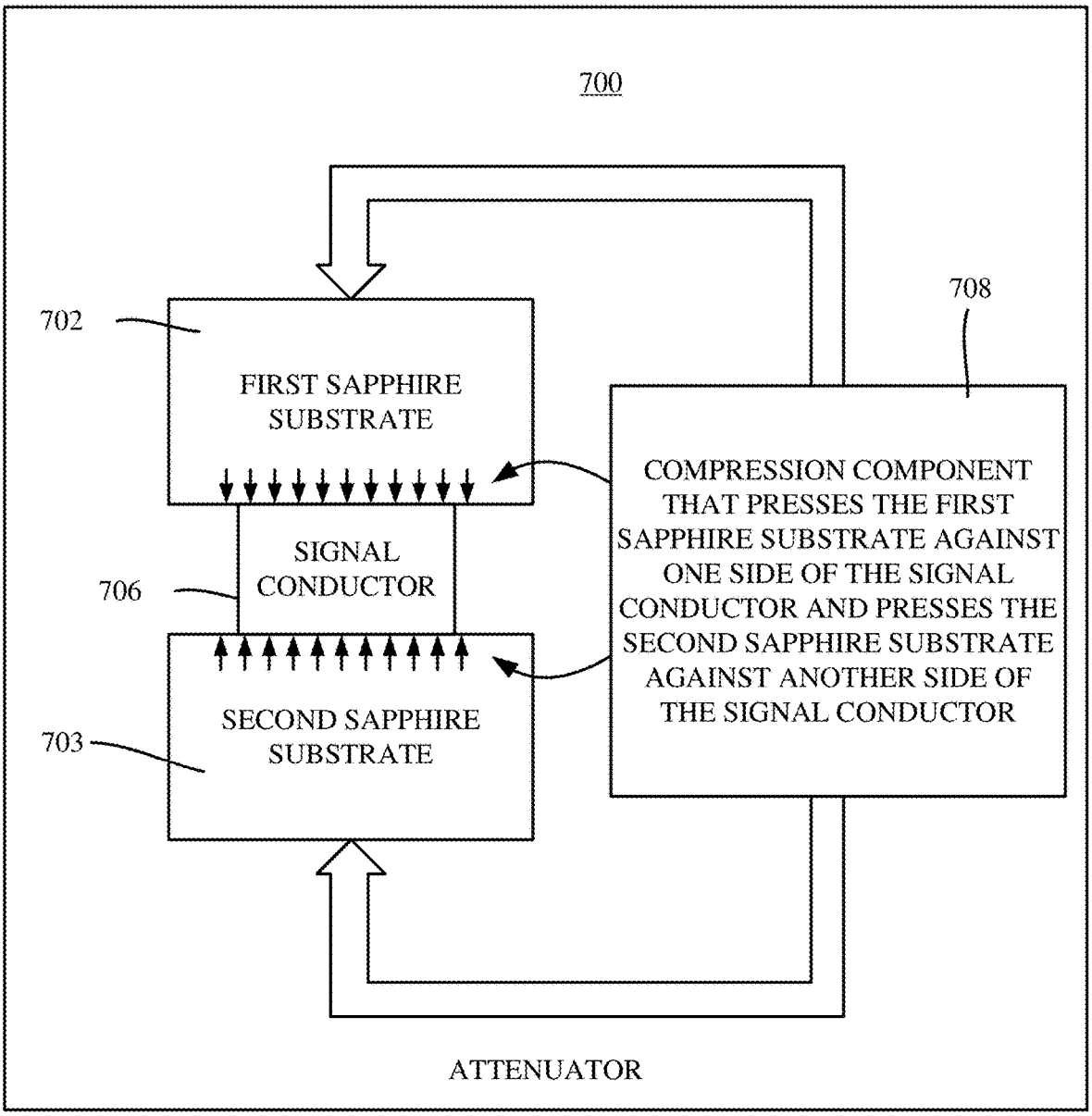
FIG. 7 is a representation of components of an attenuator according to an example embodiment of the present disclosure.

FIG. 7 is a block diagram of a device comprising an attenuator 700. The device can comprise a first sapphire substrate 702, a second sapphire substrate 703 and a signal conductor 706 between the first sapphire substrate and the second sapphire substrate. The signal conductor 706 can be compressed by a compression component 708 that presses the first sapphire substrate 702 against one side of the signal conductor and presses the second sapphire substrate 703 against another side of the signal conductor.

The compression component can comprise at least one via, or one screw. The first sapphire substrate can have a thickness of about 0.5 to 1.0 millimeter and the second sapphire substrate can have a thickness of about 0.5 to 1.0. The compression component can facilitate thermal conductivity of the signal conductor and reduce thermal boundary resistance between the substrates and the signal conductor. The signal conductor can comprise attenuator lines and resistors, substantially forming a cross shape.

Figure 8:
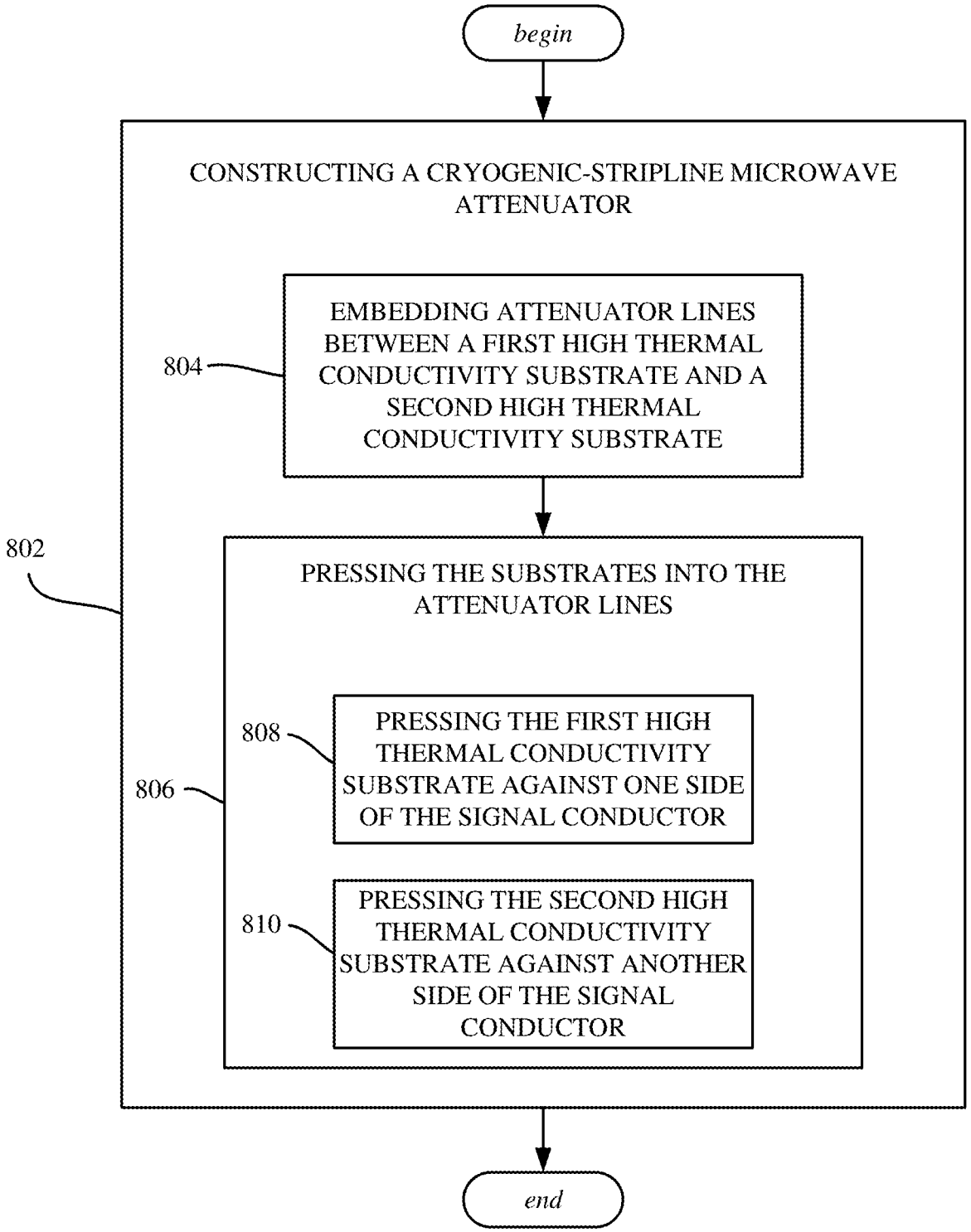
FIG. 8 is a representation of a method that provides a cryogenic-stripline attenuator according to an example embodiment of the present disclosure.

FIG. 8 exemplifies a method, such as shown as operations. The method can comprise constructing a cryogenic-stripline microwave attenuator (operation 802), which can comprise embedding attenuator lines between a first high thermal conductivity substrate and a second high thermal conductivity substrate (operation 804). Operation 806 represents pressing the substrates into the attenuator lines, which can comprise pressing the first high thermal conductivity substrate against one side of the signal conductor (operation 808) and pressing the second high thermal conductivity substrate against another side of the signal conductor (operation 810). The cryogenic-stripline microwave attenuator can be located in a cryogenic dilution refrigerator of a quantum computing device.

A device can comprise a cryogenic-stripline microwave attenuator, comprising, a signal conductor comprising an attenuator, the signal conductor having a substantially first flat side and a substantially second flat side opposite the first flat side. A first high thermal conductivity substrate is pressed against the first side of the signal conductor by a compression component, and a second high thermal conductivity substrate pressed against the second side of the signal conductor by the compression component. The first high thermal conductivity can comprise a first sapphire substrate and wherein the second high thermal conductivity can comprise a second sapphire substrate. The first high thermal conductivity substrate can have a thermal conductivity of about at least 120 Watts per meter-Kelvin.

A cryogenic-stripline microwave attenuator can comprise a signal conductor comprising an attenuator. The signal conductor can have a first side pressed against a first high thermal conductivity substrate by a compression component, and can have a second side pressed against a second high thermal conductivity substrate by the compression component. Within a dilution refrigerator, the signal conductor can receive an input signal and attenuate the input signal into an attenuated output signal. The first high thermal conductivity substrate and the second high thermal conductivity substrates can have a thermal conductivity of about at least 120 Watts per meter-Kelvin.

As can be seen, there is described a cryogenic-stripline microwave attenuator device suitable for quantum computing applications. Advantages compared to other known solutions include improved thermalization as a result of the higher thermal conductivity of the substrates. Further, thermalization is improved while thermal noise is reduced because of the reduced thermal boundary (Kapitza) resistance resulting from the high pressure on the metal lines in conjunction with the high thermal conductivity in substrate (e.g., sapphire).

What has been described above include mere examples. It is, of course, not possible to describe every conceivable combination of components, materials or the like for purposes of describing this disclosure, but one of ordinary skill in the art can recognize that many further combinations and permutations of this disclosure are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A device, comprising:

a cryogenic-stripline microwave attenuator, comprising, a signal conductor comprising one or more attenuator lines between a first high thermal conductivity substrate and a second high thermal conductivity substrate, the signal conductor compressed by compression components that press the first high thermal conductivity substrate against one side of the signal conductor and presses the second high thermal conductivity substrate against another side of the signal conductor, wherein the compression components are arranged to provide increased compression in locations of the first high thermal conductivity substrate and second high thermal conductivity substrate in contact with the signal conductor relative to other locations of the first high thermal conductivity substrate and second high thermal conductivity substrate not in contact with the signal conductor.

2. The device of claim 1, wherein the compression components comprise at least one via.

3. The device of claim 1, wherein the compression components comprise at least one screw.

4. The device of claim 1, wherein the compression components comprise at least one clamping component.

5. The device of claim 1, wherein the compression components facilitates thermal conductivity between the first high thermal conductivity substrate, the second high thermal conductivity substrate, and the signal conductor.

6. The device of claim 1, wherein the compression components reduces thermal boundary resistance between the first high thermal conductivity substrate, the second high thermal conductivity substrate, and the signal conductor to increase thermal conductivity.

7. The device of claim 1, wherein the first high thermal conductivity substrate has a thermal conductivity of at least 200 Watts per meter-Kelvin.

8. The device of claim 1, wherein the first high thermal conductivity substrate has a thickness of 0.5 to 1.0 millimeter.

9. The device of claim 1, wherein the second high thermal conductivity substrate has a thermal conductivity of at least 200 Watts per meter-Kelvin.

10. The device of claim 1, wherein the second high thermal conductivity substrate has a thickness of 0.5 to 1.0 millimeter.

11. The device of claim 1, the second high thermal conductivity substrate has a thermal conductivity of at least 150 Watts per meter-Kelvin.

12. The device of claim 1, wherein the first high thermal conductivity substrate has a thermal conductivity of at least 100 Watts per meter-Kelvin, and the second high thermal conductivity substrate has a thermal conductivity of at least 100 Watts per meter-Kelvin.

13. The device of claim 1, wherein the first high thermal conductivity substrate has a thermal conductivity of at least 150 Watts per meter-Kelvin.

14. A device, comprising:

an attenuator, comprising, compression components that presses a first high thermal conductivity substrate against a side of a signal conductor, and presses a second high thermal conductivity substrate against another side of the signal conductor, wherein the compression components are arranged to provide increased compression in locations of the first high thermal conductivity substrate and second high thermal conductivity substrate in contact with the signal conductor relative to other locations of the first high thermal conductivity substrate and second high thermal conductivity substrate not in contact with the signal conductor.

15. The device of claim 14, wherein the compression components comprises at least one via, or at least one screw.

16. The device of claim 14, wherein the first high thermal conductivity substrate has a thickness of 0.5 to 1.0 millimeter and wherein the second high thermal conductivity substrate has a thickness of 0.5 to 1.0 millimeter.

17. The device of claim 14, wherein the signal conductor comprises attenuator lines and resistors substantially forming a cross shape.

18. The device of claim 14, wherein the compression components facilitates thermal conductivity of the signal conductor and reduces thermal boundary resistance between the substrates and the signal conductor.

19. A cryogenic-stripline microwave attenuator, comprising, a signal conductor having a substantially flat first side and a substantially flat second side opposite the substantially flat first side; and compression components that presses a first high thermal conductivity substrate against the substantially flat first side of the signal conductor, and presses a second high thermal conductivity substrate pressed against the substantially flat second side of the signal conductor, wherein the compression components are arranged to provide increased compression in locations of the first high thermal conductivity substrate and second high thermal conductivity substrate in contact with the signal conductor relative to other locations of the first high thermal conductivity substrate and second high thermal conductivity substrate not in contact with the signal conductor.

20. The device of claim 19, wherein the second high thermal conductivity substrate has a thermal conductivity of at least 120 Watts per meter-Kelvin.

21. The device of claim 19, wherein the first high thermal conductivity substrate has a thermal conductivity of at least 120 Watts per meter-Kelvin.

22. A cryogenic-stripline microwave attenuator, comprising:

a signal conductor having a first side pressed against a first high thermal conductivity substrate by compression components, and having a second side pressed against a second high thermal conductivity substrate by the compression components, wherein the compression components are arranged to provide increased compression in locations of the first high thermal conductivity substrate and second high thermal conductivity substrate in contact with the signal conductor relative to other locations of the first high thermal conductivity substrate and second high thermal conductivity substrate not in contact with the signal conductor; and wherein within a dilution refrigerator, the signal conductor receives an input signal and attenuates the input signal into an attenuated signal at an output of the cryogenic-stripline microwave attenuator.

23. The cryogenic-stripline microwave attenuator of claim 22, wherein the first high thermal conductivity substrate and the second high thermal conductivity substrate respectively have thermal conductivity of at least 120 Watts per meter-Kelvin.

24. A method for constructing a cryogenic-stripline microwave attenuator, comprising:

embedding attenuator lines between a first high thermal conductivity substrate and a second high thermal conductivity substrate; and pressing, via compression components:

the first high thermal conductivity substrate against a side of the signal conductor, and the second high thermal conductivity substrate against another side of the signal conductor, wherein the compression components are arranged to provide increased compression in locations of the first high thermal conductivity substrate and second high thermal conductivity substrate in contact with the signal conductor relative to other locations of the first high thermal conductivity substrate and second high thermal conductivity substrate not in contact with the signal conductor.

25. The method of claim 18, further comprising, locating the cryogenic-stripline microwave attenuator in a cryogenic dilution refrigerator of a quantum computing device.

* * * * *